US012788144B2

(12) United States Patent
Lin

(10) Patent No.: US 12,788,144 B2
(45) Date of Patent: Nov. 10, 2026

(54) LOUNGE CHAIR AND METHOD FOR ASSEMBLING THE SAME

(71) Applicant: Shenzhen Aoqi Technology CO., Ltd, Shenzhen (CN)

(72) Inventor: Chuangxin Lin, Shenzhen (CN)

(73) Assignee: Shenzhen Aoqi Technology CO., Ltd, Shenzhen (CN)

( * ) Notice: Subject to any disclaimer, the term of this patent is extended or adjusted under 35 U.S.C. 154(b) by 170 days.

(21) Appl. No.: 18/798,712

(22) Filed: Aug. 8, 2024

(65) Prior Publication Data

US 2026/0007237 A1 Jan. 8, 2026

(30) Foreign Application Priority Data

Jul. 5, 2024 (CN) ..... 202410905818.1

(51) Int. Cl.
*A47C 4/03* (2006.01)
*A47C 5/02* (2006.01)

(52) U.S. Cl.
CPC . *A47C 4/03* (2013.01); *A47C 5/02* (2013.01)

(58) Field of Classification Search
CPC .... A47C 5/02; A47C 4/03; A47C 4/02; A47C 7/00; A47C 7/002; A47C 7/42; A47C 4/024
USPC ..... 297/440.1, 451.9, 16.1, 16.2, 440.11
See application file for complete search history.

(56) References Cited

U.S. PATENT DOCUMENTS 1,357,737 A * 11/1920 Solaini ..... D05C 1/04 38/102.2
3,082,037 A * 3/1963 Anderson ..... A47C 4/03 297/440.13
3,180,685 A * 4/1965 Rogalski ..... A47C 4/03 248/188
3,226,161 A * 12/1965 Platner ..... A47C 3/12 108/150
3,906,648 A * 9/1975 Bard ..... D05C 1/04 38/102.2
4,085,532 A * 4/1978 Hehn ..... D05C 1/04 38/102.2
4,494,344 A * 1/1985 Petcen ..... B32B 17/10018 38/102.2
6,848,740 B1 * 2/2005 Reese ..... A47C 4/02 297/53
6,877,814 B2 * 4/2005 Lin ..... A47C 5/06 297/440.22

(Continued)

FOREIGN PATENT DOCUMENTS

CN 208425784 U 1/2019

OTHER PUBLICATIONS

ISR for PCT/CN2025/103825.
Written opinions of ISA for PCT/CN2025/103825.

*Primary Examiner* — Maria E Graber

(57) ABSTRACT

A lounge chair includes: an upper frame; a number of linkage bars that are detachably connected to the upper frame; a number of legs that are respectively connected to the linkage bars; a support frame detachably connected to the linkage bars or the legs; a fixing mechanism detachably connected to the support frame; and a flexible support member for providing support to a body of a user. The flexible support member has an upper end fixed to the upper frame, and a lower end fixed to the fixing mechanism.

20 Claims, 14 Drawing Sheets

(56) References Cited

U.S. PATENT DOCUMENTS

| | | | | |
|---|---|---|---|---|
| 7,152,929 | B2 * | 12/2006 | Wu | A47C 31/02 297/452.56 |
| D755,549 | S * | 5/2016 | Akkad | D6/716 |
| D756,155 | S * | 5/2016 | Akkad | D6/369 |
| D773,842 | S * | 12/2016 | Frankel | D6/368 |
| 10,130,180 | B2 * | 11/2018 | Frankel | A47C 4/02 |
| 2004/0160105 | A1 * | 8/2004 | Tseng | A47C 4/02 297/344.21 |
| 2005/0057085 | A1 * | 3/2005 | Wu | B29C 66/8322 297/452.56 |
| 2006/0158010 | A1 * | 7/2006 | Hsieh | A47C 4/48 297/16.1 |
| 2009/0289490 | A1 * | 11/2009 | Lin | A47C 31/023 297/445.1 |
| 2017/0119160 | A1 * | 5/2017 | Frankel | A47C 4/48 |
| 2019/0090641 | A1 * | 3/2019 | Frankel | A47C 7/00 |
| 2021/0127837 | A1 * | 5/2021 | Frankel | A47C 4/42 |

* cited by examiner

LOUNGE CHAIR AND METHOD FOR ASSEMBLING THE SAME

CROSS REFERENCE TO RELATED APPLICATIONS

This application claims priority to Chinese Patent Application No. CN 202410905818.1, filed Jul. 15, 2024, which is hereby incorporated by reference herein as if set forth in its entirety.

TECHNICAL FIELD

The present disclosure generally relates to chairs, and in particular relates to a lounge chair and a method for assembling the lounge chair.

BACKGROUND

Assembly of some rattan-like products (e.g., rattan-like chairs) typically involves first securing the overall frame, and then weaving the rattan strips onto the fixed frame. These types of products may have the following issues: Firstly, because the frame is fixed, skilled personnels are required to ensure the tightness of the rattan strips after weaving, leading to high labor costs. Additionally, weaving is time-consuming and difficult. Furthermore, during packaging, the large size of the fixed frame can result in high transportation costs.

Therefore, there is a need to provide a lounge chair to overcome the above-mentioned problems.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
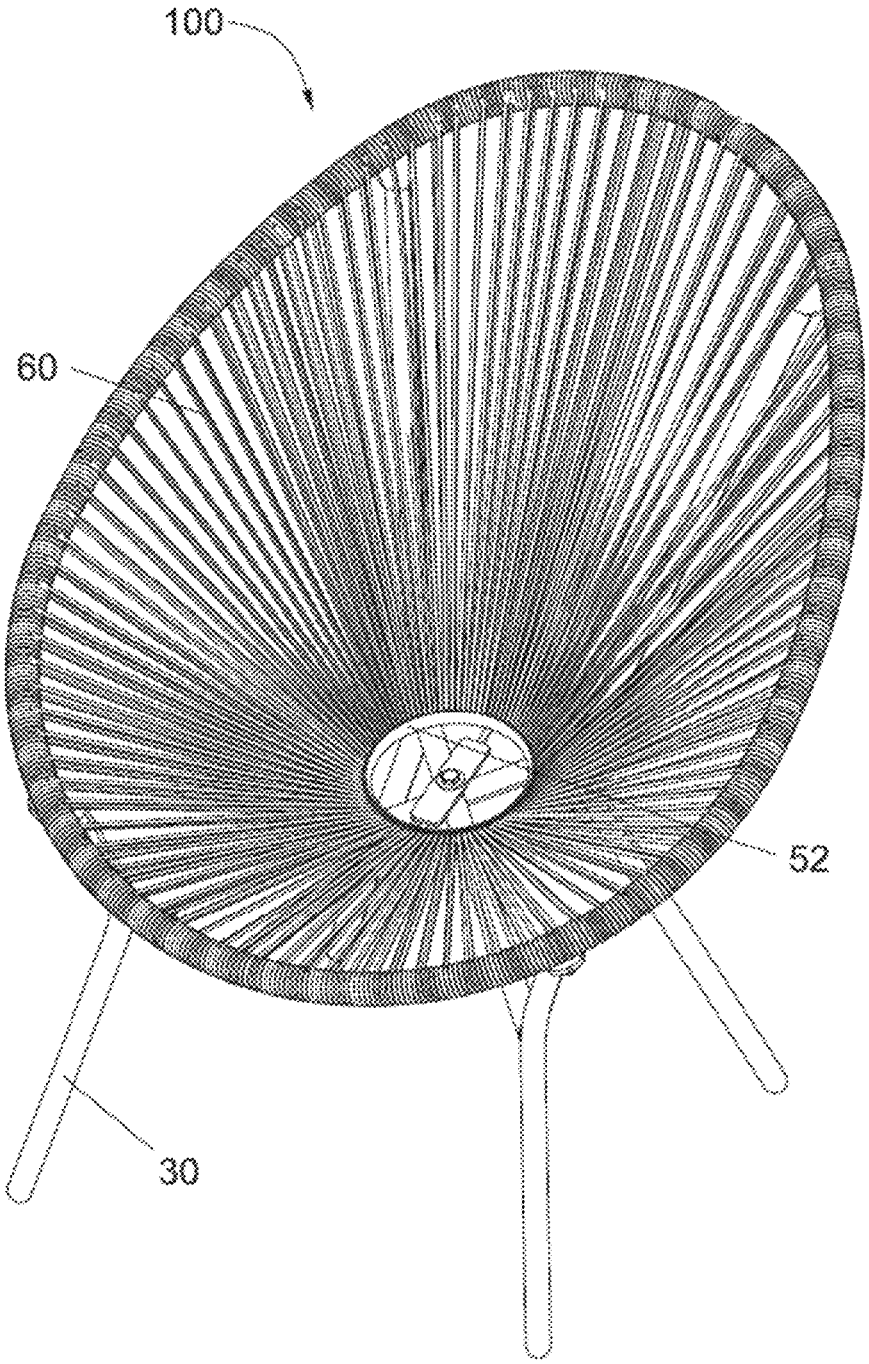
FIG. 1 is an isometric view of a lounge chair according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 2:
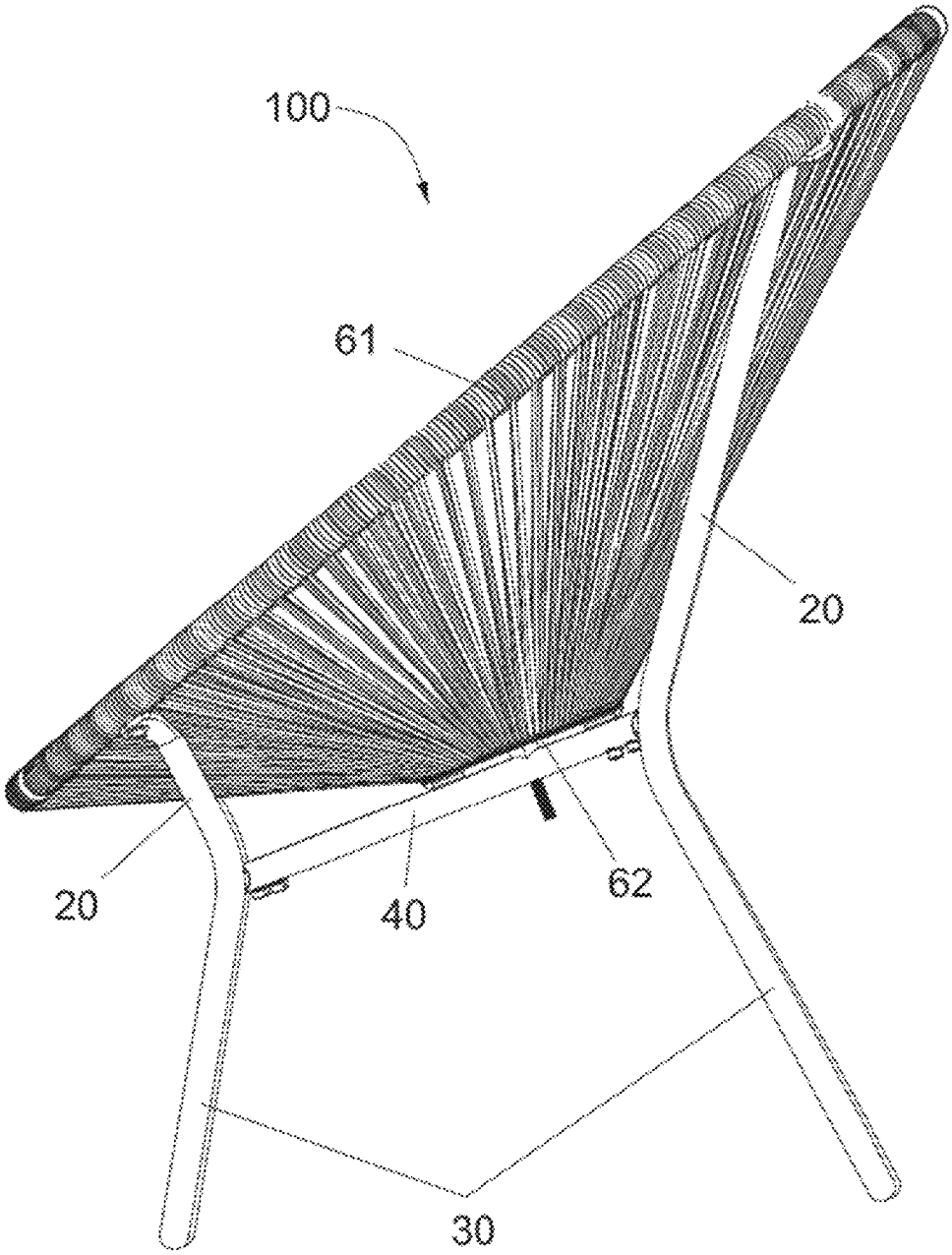
FIG. 2 is an isometric view of the lounge chair viewed from another perspective.
Figure 3:
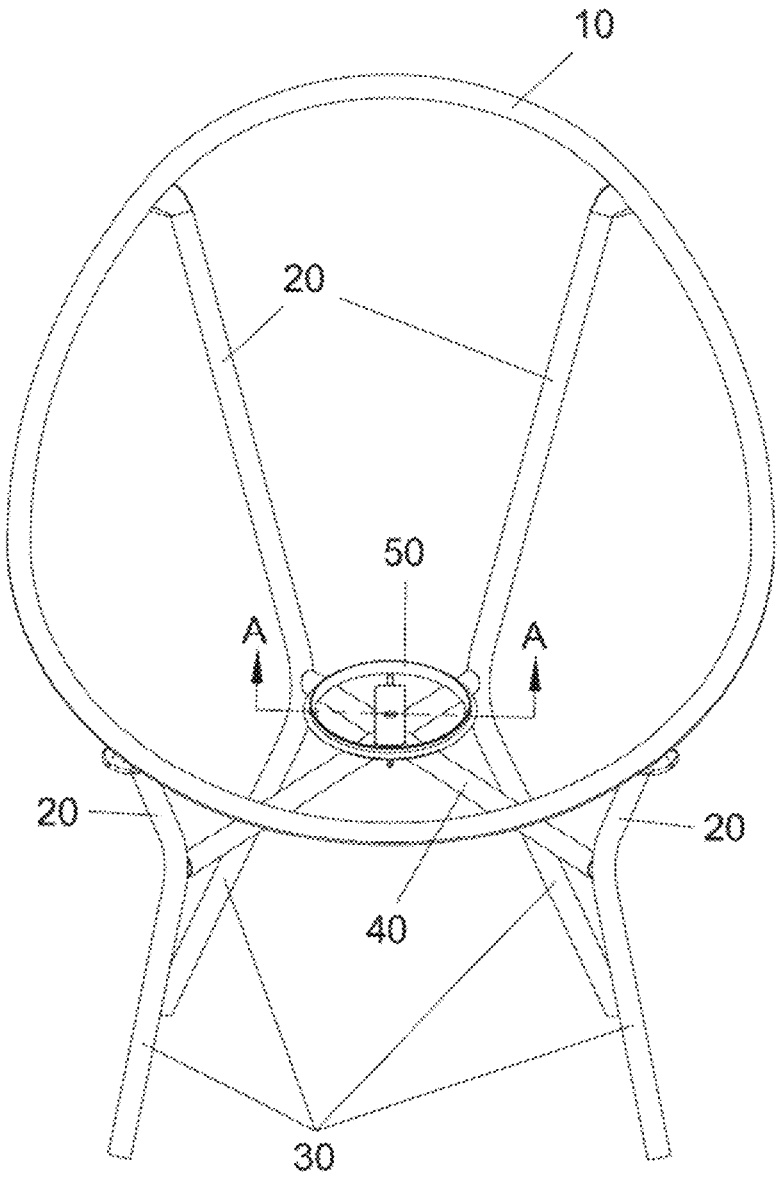
FIG. 3 is an isometric view of the lounge chair viewed from another perspective, with the flexible support member omitted.

Referring to FIGS. 1 to 3, in one embodiment, a lounge chair 100 may include an upper frame 10, a number of linkage bars 20, a number of legs 30, a support frame 40, a fixing mechanism 50, and a flexible support member. The linkage bars 20 are detachably connected to the upper frame 10. The legs 30 are respectively connected to the linkage bars 20. The linkage bars 20 and the legs 30 are collectively referred to as a base frame. The support frame 40 is detachably connected to the linkage bars 20 or the legs 30. The fixing mechanism 50 is detachably connected to the support frame 40. The flexible support member can provide support to the body of a user, and may include an upper end fixed to the upper frame 10, and a lower end fixed to the fixing mechanism 50.

With the above-mentioned configuration, the frame assembly including the upper frame 10, linkage bars 20, legs 30, support frame 40, and fixing mechanism 50 of the lounge chair 100 can be disassembled when needed. For example, when the lounge chair 100 needs to be transported from one place to another, the lounge chair 100 can be disassembled, and the space occupied by the above-mentioned components of the disassembled lounge chair 100 is smaller than the space occupied by the assembled leisure chair 100 as shown in FIG. 1, thereby facilitating the reduction in transportation costs.

Figure 5:
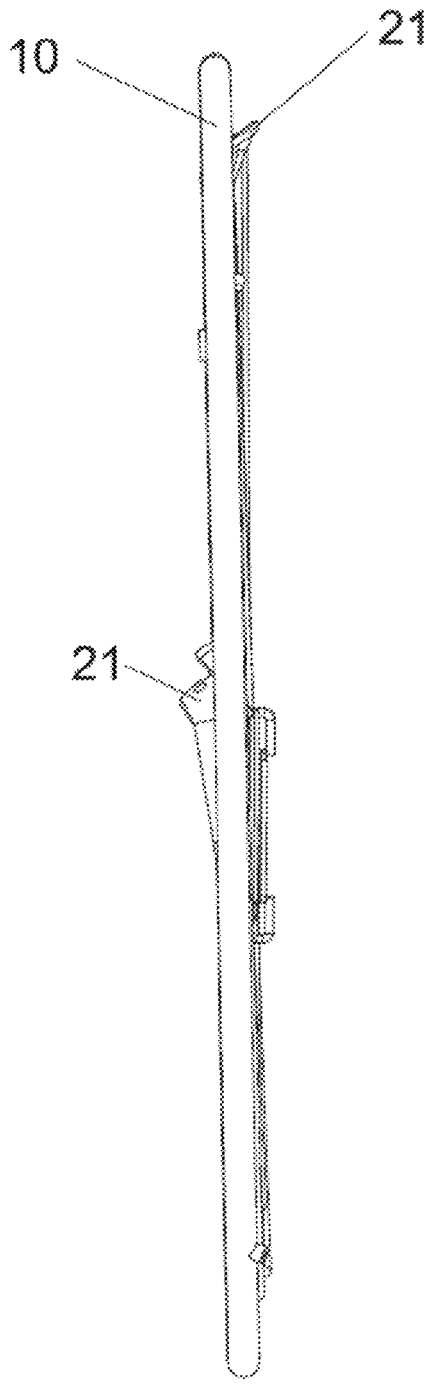
FIG. 5 is a side view of the flat structure shown in FIG. 4.

In one embodiment, the upper frame 10 can be made of metal material, for example, a stainless-steel tube. The upper frame 10 can be a closed ring or a non-closed ring. However, in any case, the upper frame 10 is substantially a flat structure. The flat structure here means that the upper frame 10 has a very small thickness as a whole. Specifically, in the embodiment as shown in FIG. 3, the upper frame 10 is generally an elliptical ring when viewed from the front. Referring to FIGS. 2 and 5, when viewed from the side, the upper frame 10 is a straight structure with a uniform width, and the uniform width is determined by the metal tube forming the upper frame 10. For example, when the cross section of the metal tube is circular, the uniform width is equal to the outer diameter of the metal tube. In this case, the overall thickness of the upper frame 10 is equal to the outer diameter of the metal tube. On the premise of being able to provide sufficient support for the user, the overall thickness of the upper frame 10 is as small as possible, so that the space occupied by the upper frame 10 in its thickness direction is small.

Figure 4:
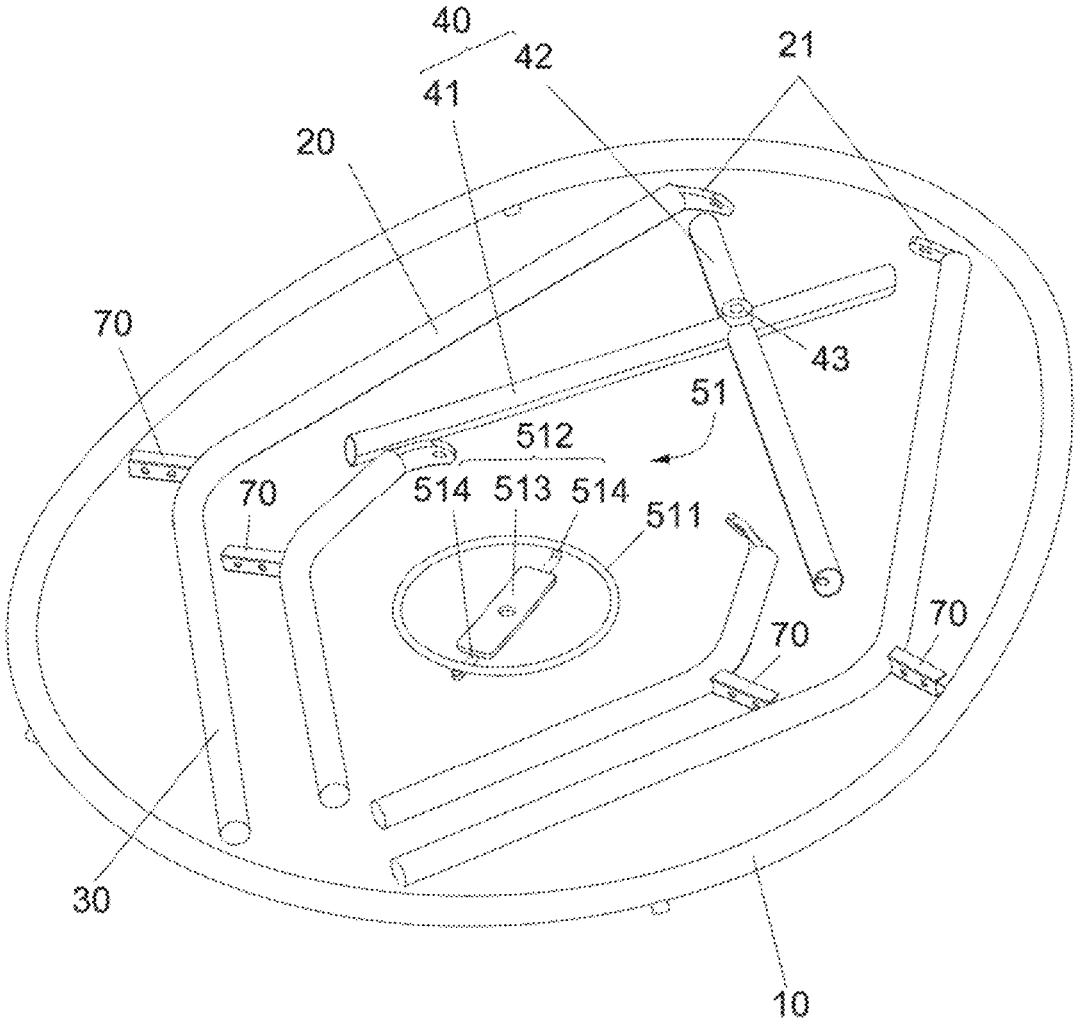
FIG. 4 is a schematic diagram of a flat structure formed by disassembled components of the lounge chair.

In one embodiment, the number of the linkage bars 20 is 4, and the legs 30 correspond one-to-one with the linkage bars 20. Therefore, the number of legs 30 is also four. It should be noted that the number of linkage bars 20 and the number of legs 30 are not limited, and they can be changed according to actual needs. Additionally, it should be noted that the lengths of the four linkage bars 20 are not exactly the same in this embodiment. Referring to FIGS. 2 and 4, the lengths of two linkage bars 20 are obviously greater than the lengths of the other two linkage bars 20. Similarly, the lengths of the four legs 30 are not exactly the same in this embodiment, and the lengths of two legs 30 are greater than the lengths of the other two legs 30. In one embodiment, the length of the linkage bars 20 and the length of the legs 30 are mainly selected depending on whether the upper frame 10 is inclined relative to the surface (such as the floor) contacted by the lower ends of the legs 30. It should be noted that the length of the linkage bars 20 and the length of the legs 30 can be changed according to actual needs.

In one embodiment, each linkage bar 20 and its corresponding leg 30 are integrally formed. Each linkage bar 20 and its corresponding leg 30 are substantially straight rods and can be made of metal material, such as stainless-steel tube. Each linkage bar 20 and its corresponding leg 30 extend in different directions, and the angle between them is an obtuse angle. For the convenience of description, each linkage bar 20 and its corresponding leg 30 are collectively referred to as "support rod." In the embodiment shown in FIGS. 3 and 4, the linkage bars 20 and legs 30 form four support rods, and the four support rods are substantially flat structures. That is, each support rod has a small thickness as a whole. Referring to FIGS. 4 and 5, in side view, each support rod is substantially a straight structure with a uniform width, and the uniform width is determined by the metal tube forming the support rod. For example, when the cross section of the metal tube is circular, the uniform width is substantially equal to the outer diameter of the metal tube. In this case, the overall thickness of each support rod is substantially equal to the outer diameter of the metal tube. On the premise of being able to provide sufficient support for the user, the overall thickness of each support rod is as small as possible, so that the space occupied by each support rod in the thickness direction is small.

It should be noted that each linkage bar 20 and its corresponding leg 30 can be independent components, which can be manufactured separately and then connected together by conventional connection techniques (such as fasteners).

Figure 6:
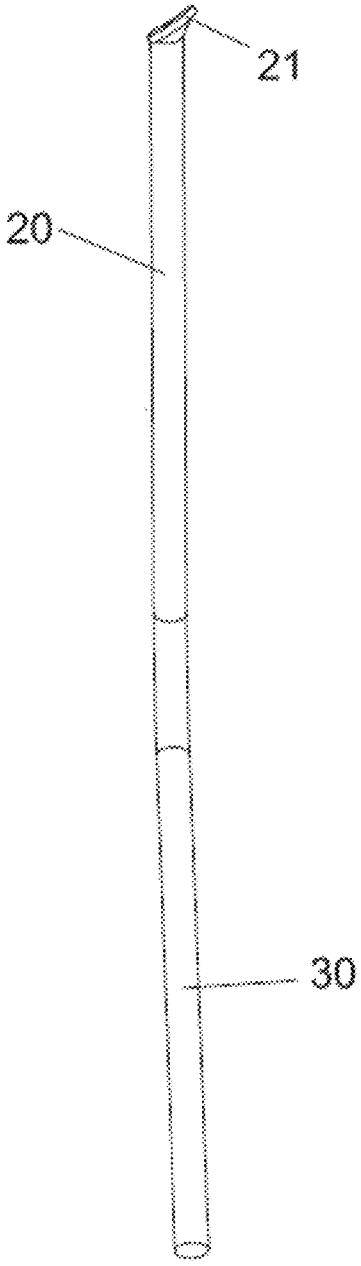
FIG. 6 is a side view of a support rod formed by a linkage bar and a leg of the lounge chair.

Referring to FIG. 6, it can be seen that, in side view, each support rod is not a straight structure with a completely uniform width. This is because the top end of each linkage bar 20 is provided a connecting tab 21 (see FIG. 4). When the lower ends of the legs 30 rest on the surface (e.g., the floor) supporting it, the upper frame 10 is inclined relative to the surface. In order to adapt to the inclined upper frame 10, the connecting tab 21 is inclined relative to the linkage bar 20 connected thereto, and its maximum width is greater than the outer diameter of the linkage bar 20 connected thereto. Therefore, in side view, each support rod is not a straight structure with a completely uniform width. The maximum thickness of each support rod due to the existence of its corresponding connecting tab 21 is slightly greater than the outer diameter of the metal tube forming the support rod.

In one embodiment, the top end of each linkage bar 20 can be detachably connected to the upper frame 10 by a fastener (such as a screw). For example, the connecting tab 21 formed at the top end of each linkage bar 20 is provided with a through hole, and the upper frame 10 is provided with a corresponding threaded hole. The linkage bar 20 can be detachably connected to the upper frame 10 by a screw that passes through the through hole on the connecting tab 21 and is screwed into the threaded hole in the upper frame 10.

It should be noted that the manner in which the linkage bars 20 are detachably connected to the top frame 10 is not limited, and when necessary, other conventional connecting techniques may be employed to detachably connect the linkage bars 20 to the upper frame 10.

In one embodiment, the support frame 40 includes a first rod 41 and a second rod 42 connected to each other and intersecting each other. The first rod 41 and the second rod 42 can be made of metal material, for example, a stainless-steel tube. The support frame 40 is generally a flat structure, that is, the support frame 40 as a whole has a very small thickness. In side view, the support frame 40 is generally a straight structure with a uniform width, and the uniform width is determined by the metal tube forming the support frame 40. For example, when the cross section of the metal tube is circular, the uniform width is approximately equal to the outer diameter of the metal tube. In this case, the overall thickness of the support frame 40 is approximately equal to the outer diameter of the metal tube. On the premise of being able to provide sufficient support for the user, the overall thickness of the support frame 40 is as small as possible, so that each support frame 40 occupies a small space in its thickness direction.

In one embodiment, the support frame 40 can be detachably connected to the linkage bars 20 or the legs 30 by fasteners. For example, the ends of the first rods 41 and the second rods 42 that cross each other are both open ends. A connecting block 70 (see FIG. 4) protrudes from the outer surface of each linkage bar 20 or leg 30, and multiple threaded holes are defined in the connecting block 70. The outer surfaces of the first rod 41 and the second rod 42 are provided with through holes near their open ends. When connecting the support frame 40 to the linkage bars 20 or legs 30, the connecting blocks 70 are inserted into the first rod 41 and the second rod 42 through their open ends, with the through holes on the outer surfaces of the first rod 41 and the second rod 42 aligned with the threaded holes on the connecting blocks 70. Then, screws can be passed through the through holes on the outer surfaces of the first rod 41 and the second rod 42 and screwed into the threaded holes on the connecting blocks 70 to connect the support frame 40 to the linkage bars 20 or legs 30. In one embodiment, after the support frame 40 is connected to the linkage bars 20 or legs 30, it is tilted relative to the surface (such as the floor) supporting the legs 30 (see FIG. 2).

It should be noted that the manner in which the support frame 40 is detachably connected to the linkage bars 20 or legs 30 is not limited, and other conventional connecting techniques may be employed to detachably connect the support frame 40 to the linkage bars 20 or legs 30 when necessary.

Referring to FIG. 2, in one embodiment, the flexible support member includes a number of elongated flexible members. For example, the flexible support member may include a number of elongated flexible plastic strips (e.g., polyethylene rattan strips) 60 with certain flexibility. The upper end 61 of each plastic strip 60 is fixed to the upper frame 10, and the lower end 62 of each plastic strip 60 is fixed to the fixing mechanism 50. The intense arrangement of the plastic strips 60 can provide sufficient and comfortable support for the back, buttocks and legs of a user. It can be understood that in other embodiments, the flexible support member is not limited to the aforementioned plastic strips, and it can be made of other suitable materials with certain flexibility. For example, the flexible support member can be a whole piece of cloth with certain flexibility, which is roughly in the shape of a truncated cone, and the end with a smaller area of the truncated cone (i.e., the bottom end of the cloth) is fixed to the fixing mechanism 50, and the end with a larger area of the truncated cone (i.e., the top end of the cloth) is fixed to the upper frame 10.

Referring to FIG. 4, in one embodiment, the fixing mechanism 50 includes a fixing ring 51, and the fixing ring 51 includes an outer ring 511 and a fixing member 512 fixed to the outer ring 511. The lower end of each plastic strip 60 is fixed to the outer ring 511, and the fixing member 512 is detachably connected to the support frame 40.

Referring to FIG. 4, in one embodiment, the fixing member 512 spans the outer ring 511. Specifically, the fixing member 512 includes a flat body 513 and connecting rods 514 extending from opposite ends of the body 513, and the ends of the two connecting rods 514 are connected to the outer ring 511. In one embodiment, the body 513 can be fixed to the support frame 40 by fasteners (such as screws). For example, the support frame 40 has a boss 43 protruding at the intersection of the first rod 41 and the second rod 42, and a threaded hole is defined in the top of the boss 43. A through hole is defined in the body 513, and the fixing member 512 can be detachably connected to the boss 43 by a screw that passes through the through hole on the body 513 and is screwed into the threaded hole on the boss 43. That is, the fixing member 50 is thus detachably connected to the support frame 40.

In one embodiment, when only the fixing mechanism 50 is employed to fix the plastic strips 60, a number of through holes may be evenly arranged on the outer ring 511 of the fixing mechanism 50 along the peripheral direction. For example, the lower end of each plastic strip 60 can pass through the through hole on the outer ring 511 and is then fixed to the outer ring 511 by knotting or the like. For another example, each plastic strip 60 can pass through the through hole on the outer ring 511 and is fixed to the upper frame 10.

Figure 7:
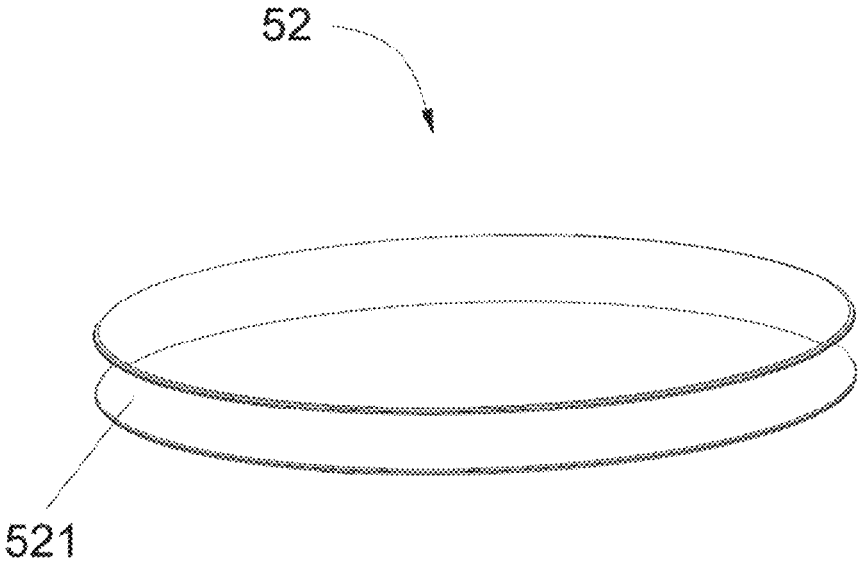
FIG. 7 is an isometric view of an inner ring of the lounge chair.
Figure 8:
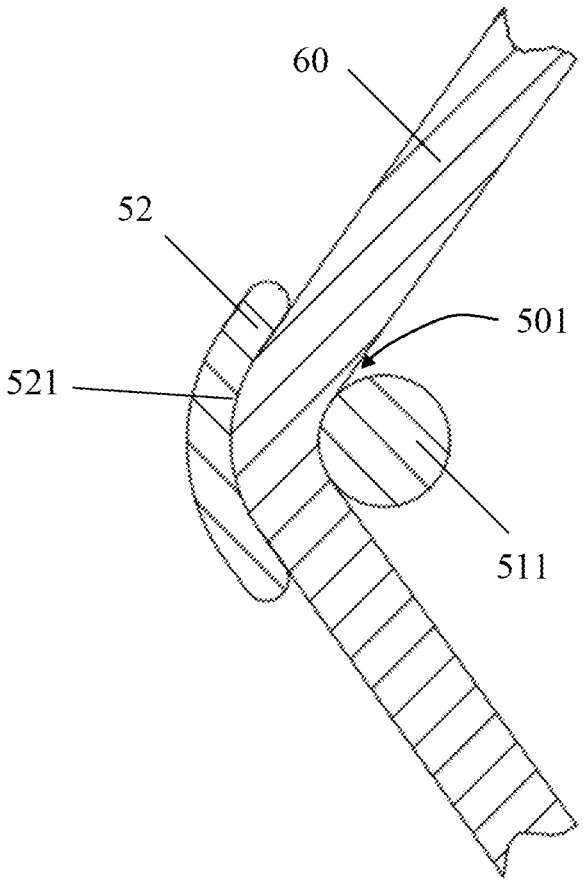
FIG. 8 is a partial cross-sectional view of a fixing mechanism of the lounge chair along the line A-A in FIG. 3.

Referring to FIGS. 1, 3 and 7, in one embodiment, the fixing mechanism 50 further includes an inner ring 52, the outer ring 511 surrounds the inner ring 52, and the lower end of each plastic strip 60 is clamped in the gap 501 between the inner ring 52 and the outer ring 511, which can be seen in FIG. 8. The function of the inner ring 52 will become clear through the description below.

Figure 9:
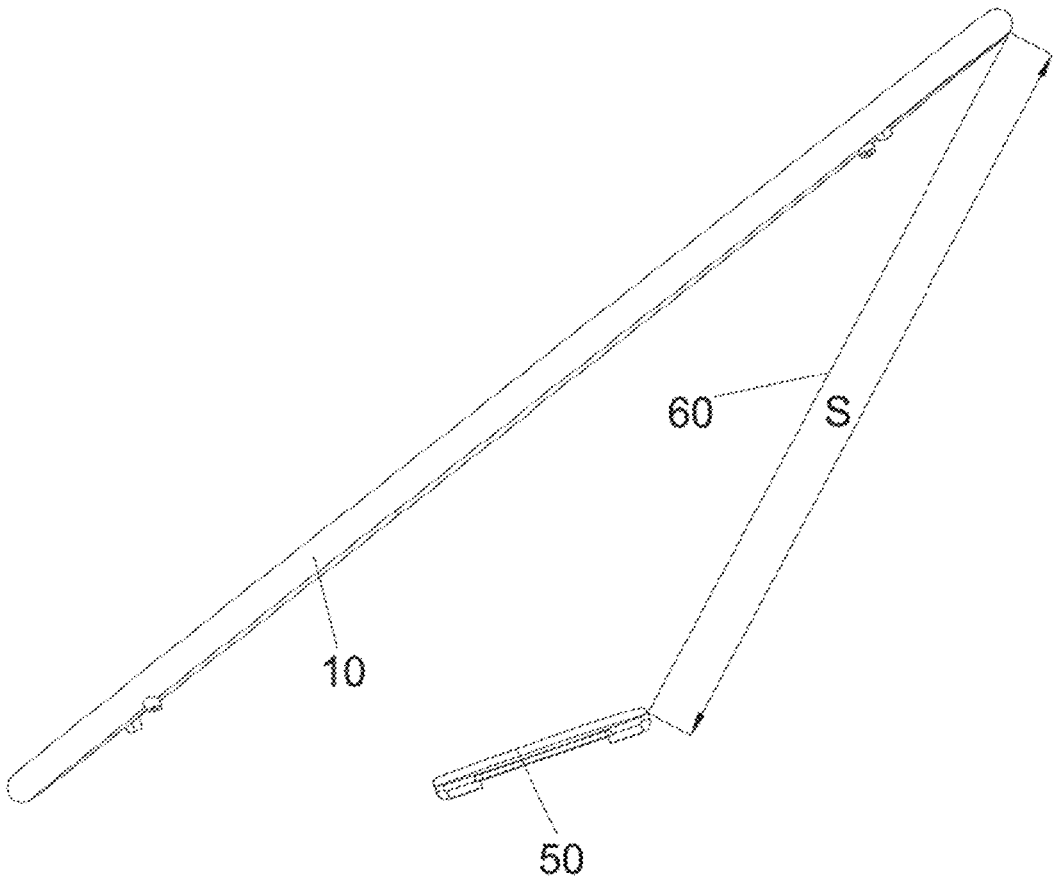
FIG. 9 is a side view of the upper frame and the fixing mechanism of the lounge chair when they are fixed to an auxiliary fixture.
Figure 10:
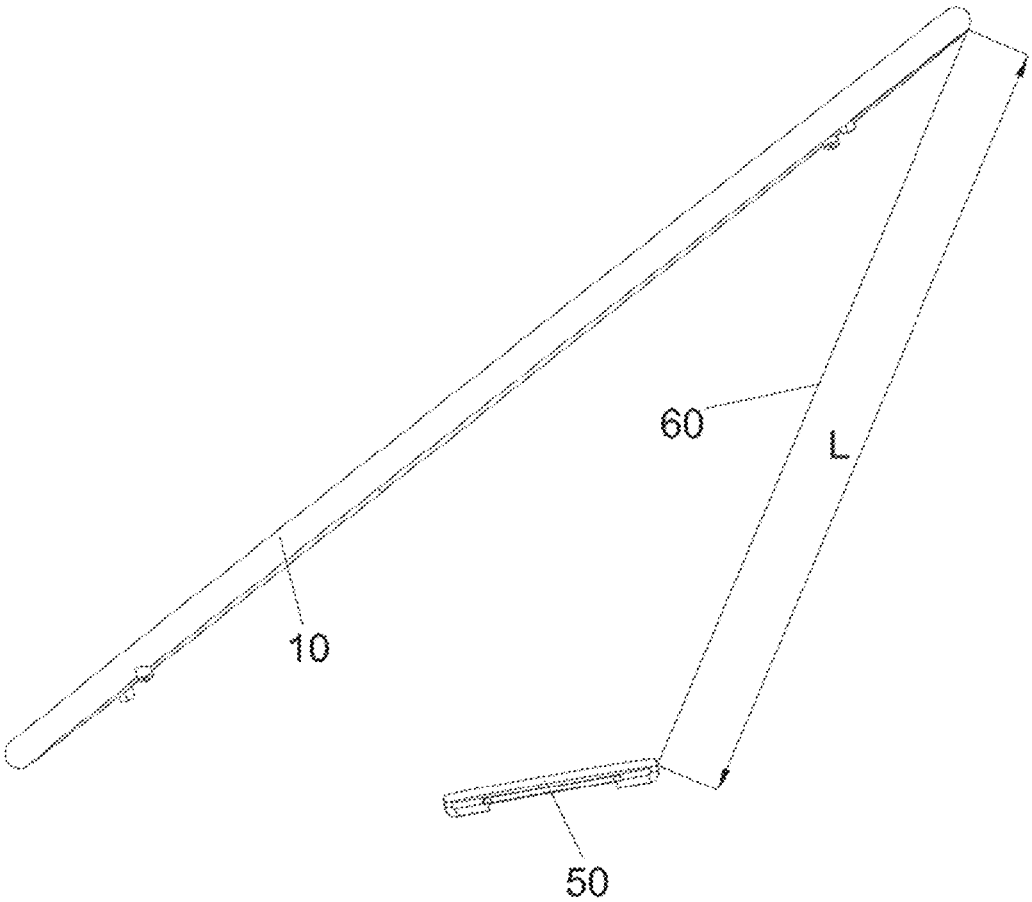
FIG. 10 is a side view of the lounge chair, with all components except the upper frame and the fixing mechanism omitted.

During the manufacturing process of the lounge chair 100, the opposite ends of the plastic strips 60 need to be fixed to the upper frame 10 and the fixing mechanism 50. Specifically, referring to FIG. 9, the upper frame 10 and the fixing member 50 are respectively fixed to an auxiliary fixture (not shown), and then the opposite ends of each plastic strip 60 are respectively fixed to the top frame 10 and the fixing member 50. Each plastic rattan 60 is now in a straightened state. However, for any plastic strip 60, its length shown in FIG. 9 is slightly shorter than the length in the assembled lounge chair 100 shown in FIGS. 1 and 10. That is, for any plastic strip 60, its length in FIG. 9 is S, and its length in FIGS. 1 and 10 is L, and S is less than L, which makes each plastic strip 60 in the lounge chair 100 shown in FIG. 1 be in a straightened and tightened state after the user assembles it, which is conducive to providing sufficient and comfortable support for the user, and is conducive to the aesthetics of the lounge chair 100.

After the opposite ends of each plastic strip 60 are fixed to the upper frame 10 and the fixing mechanism 50, the upper frame 10 and the fixing mechanism 50 need to be removed from the aforementioned auxiliary fixture, and then the upper frame 10, the fixing mechanism 50 and the plastic strips 60 are placed in the manner shown in FIG. 4. If no measures are taken, the placement of the upper frame 10, the fixing mechanism 50 and the plastic strips 60 as shown in FIG. 4 may cause the plastic strips 60 to be messy. In order to prevent this situation, the lounge chair 100 is provided with the above-mentioned inner ring 52. Before the upper frame 10 and the fixing mechanism 50 are removed from the aforementioned auxiliary fixture, the inner ring 52 is placed in the outer ring 511, so that the portion of each plastic strip 60 close to its lower end is tightly clamped in the gap between the inner ring 52 and the outer ring 511. In one embodiment, referring to FIG. 8, the outer surface 521 of the inner ring 52 facing the outer ring 511 is a concave surface. Due to the restriction of the concave surface, each plastic strip 60 is not prone to deflection and cause the aforementioned disorder.

After the opposite ends of the plastic strips 60 are fixed to the upper frame 10 and the fixing mechanism 50, and the upper frame 10 and the fixing mechanism 50 are removed from the aforementioned auxiliary fixture, since the upper frame 10, the support rods formed by the multiple linkage bars 20 and the legs 30, the support frame 40, and the fixing mechanism 50 are all flat structures, the thickness of the above-mentioned components can be roughly the same, and the above-mentioned components can form a flat structure as shown in FIGS. 4 and 5. That is, the multiple linkage bars 20 and the legs 30, the support frame 40, and the fixing mechanism 50 are placed within the range defined by the upper frame 10. The storage space required for such a flat structure is much smaller than the storage space occupied by the conventional assembled lounge chair, which is conducive to reducing transportation costs.

Figure 11:
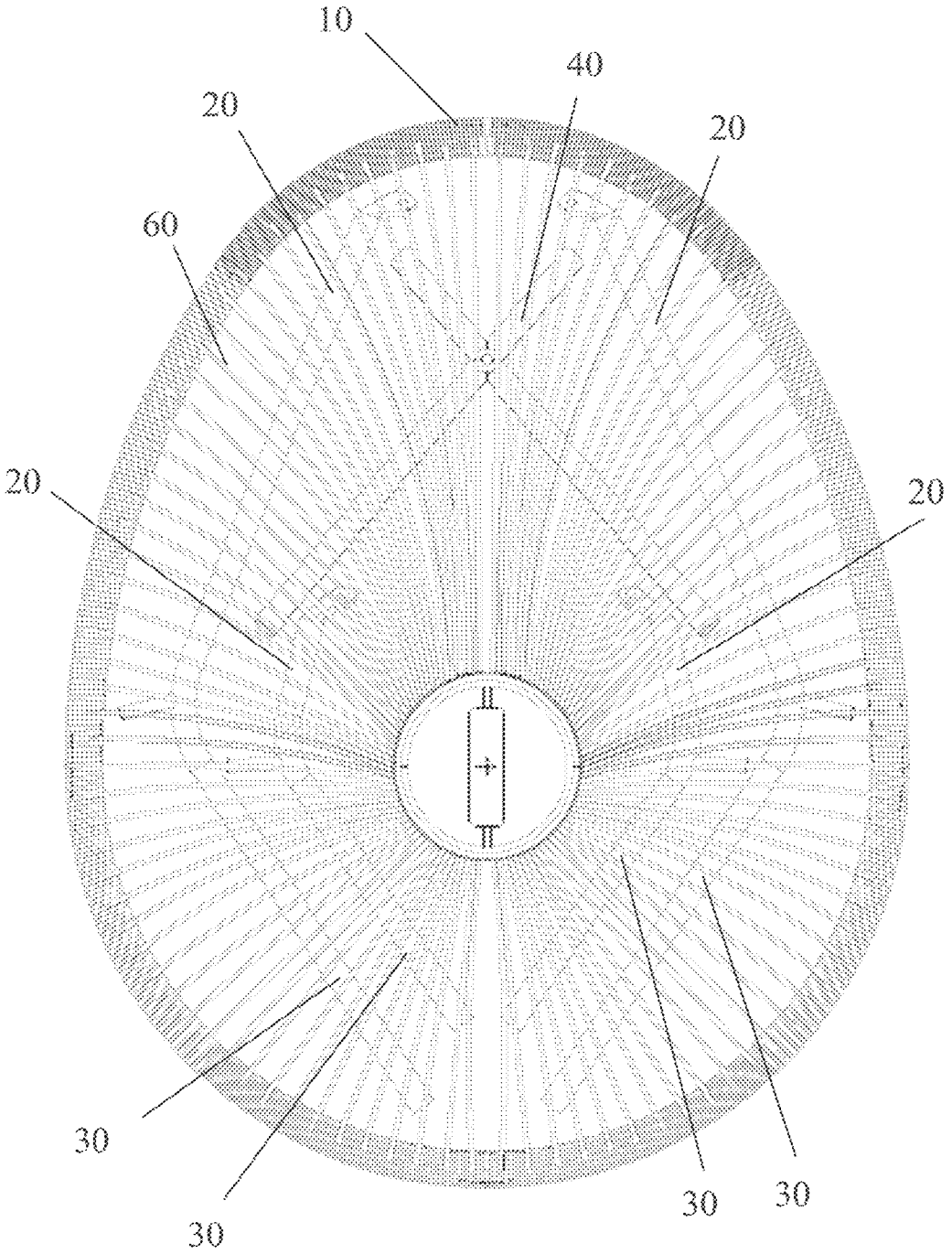
FIG. 11 is a front view of a flat structure formed by disassembled components of the lounge chair.
Figure 12:
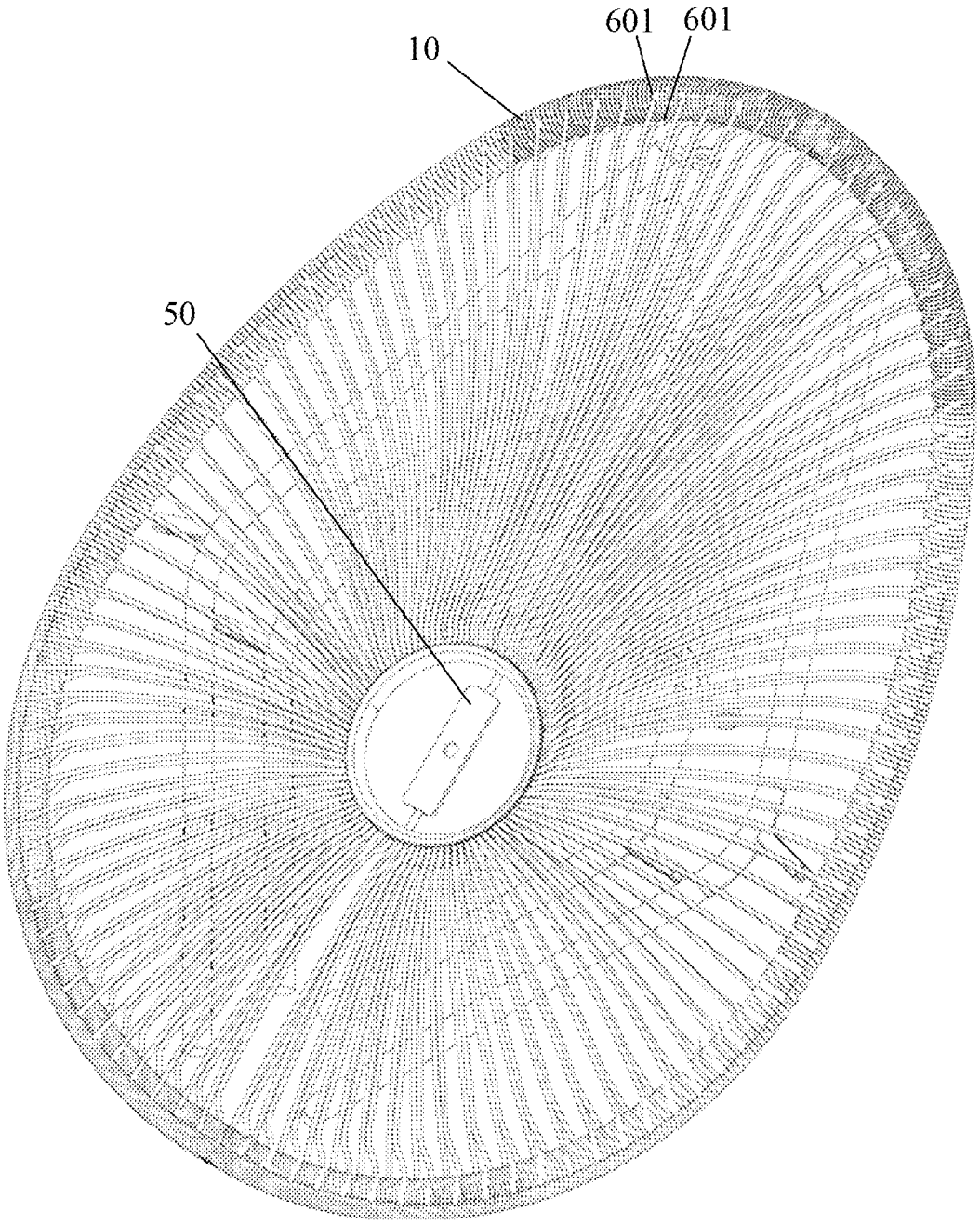
FIG. 12 is an isometric view of the flat structure formed by disassembled components of the lounge chair.
Figure 13:
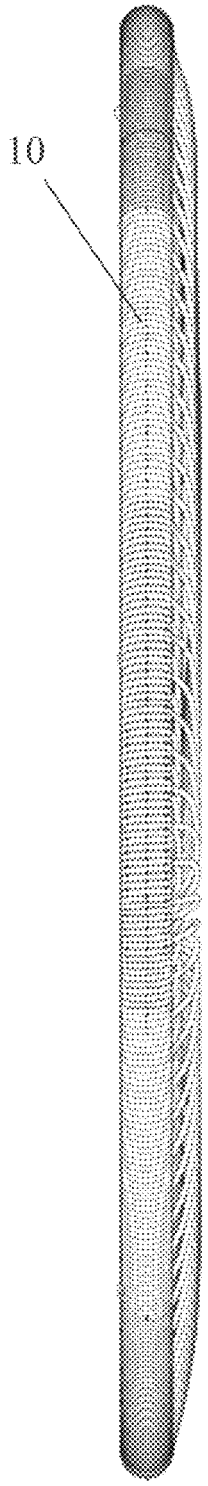
FIG. 13 is a side view of the flat structure formed by disassembled components of the lounge chair.
Figure 14:
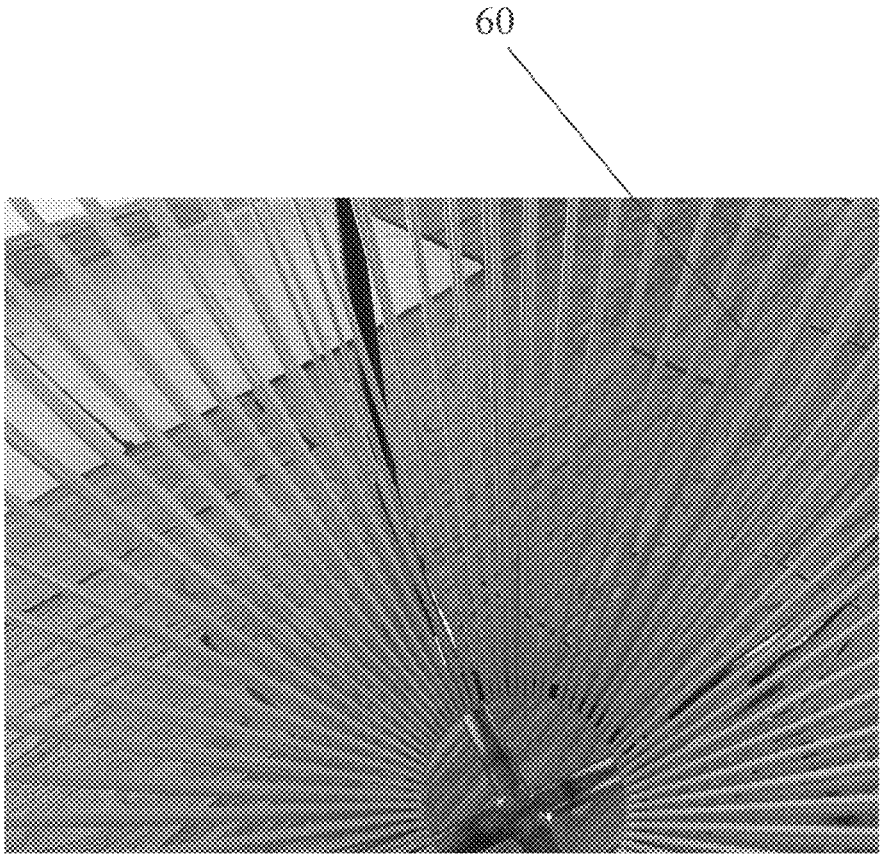
FIG. 14 is a portion of a photo of the lounge chair, which illustrates that the plastic strips are in a straightened and tightened state.

After the upper frame 10, the support rods composed of the linkage bars 20 and the legs 30, the support frame 40, and the fixing mechanism 50 are delivered to the user in a flat structure package as shown in FIGS. 11 to 13, the user can assemble the lounge chair 100 according to the following process: Connect the upper frame 10, the linkage bars 20, the legs 30, and the support frame 40 together. Then, connect the fixing mechanism 50 to the support frame 40 until the plastic strips 60 are tightened. That is, connection of the fixing mechanism 50 to the support frame 40 causes the elongated flexible members to be gradually tightened. As for any one of the plastic strips 60, its length in FIG. 9 is S, and its length in FIG. 10 is L, and S is less than L, in the process of the fixing member 512 of the fixing mechanism 50 being connected to the support frame 40, the outer ring 511 gradually tightens the plastic strips 60. Through such an assembling method, the user can easily assemble the lounge chair 100, and the plastic strips 60 of the assembled lounge chair 100 are in a tightened state (see FIG. 14), which is beneficial to provide sufficient and comfortable support for the user and is beneficial to the aesthetics of the lounge chair 100.

Referring to FIGS. 8 and 12, in another embodiment, each of the strips 60 passes through the gap 501 defined in the fixing mechanism 50, with two opposite ends (i.e., two upper ends 601) of each of the strips 60 being fixedly connected to the upper frame 10. The strips 60 are clamped in the gap 501 and arranged sequentially along an extending direction of the gap 501. Here, since the gap 501 is formed between the outer ring 511 and inner ring 52, the gap 501 is an annular gap and the strips 60 are arranged sequentially along a circumferential direction of the gap 501. In the embodiment, each of the flexible strips 60 is integrally formed as a single piece extending between two opposite ends (i.e., two upper ends 601) thereof.

Referring to FIGS. 4-5 and 11, the upper frame 10, the flexible support member (i.e., strips 60), the linkage bars 20, the legs 30, the support frame 40 and the fixing mechanism 50 are configured to form a flat structure after being disassembled. When the lounge chair is in a flat packaged configuration, the linkage bars 20, the legs 30, the support frame 40, and the fixing mechanism 50 are all positioned within a projected contour of the upper frame 10, which is clearly shown in FIG. 11. Here, the projected contour refers to an outer boundary formed by projecting the upper frame 10 onto a plane along the packaging thickness direction (or a viewing direction).

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A lounge chair comprising:

an upper frame;

a plurality of linkage bars that are detachably connected to the upper frame;

a plurality of legs, each connected to one of the linkage bars;

a support frame detachably connected to the plurality of linkage bars or the plurality of legs;

a fixing mechanism detachably connected to the support frame; and a flexible support member comprising a plurality of flexible strips;

wherein each of the strips passes through a gap defined in the fixing mechanism, with two opposite ends of each of the strips being fixedly connected to the upper frame; and the plurality of flexible strips are clamped in the gap and arranged sequentially along an extending direction of the gap.

2. The lounge chair of claim 1, wherein each of the linkage bars is formed integrally with the one of the legs.

3. The lounge chair of claim 1, wherein each of the flexible strips is integrally formed as a single piece extending between two opposite ends thereof.

4. The lounge chair of claim 1, wherein the fixing mechanism comprises an inner ring, an outer ring and a fixing member fixed to the outer ring, the gap is defined between the inner ring and the outer ring, and the fixing member is detachably connected to the support frame.

5. The lounge chair of claim 4, wherein the outer ring is configured to gradually tighten the plurality of strips during a process of the fixing member being connected to the support frame.

6. The lounge chair of claim 5, wherein the inner ring comprises an outer surface facing the outer ring, and the outer surface is a concave surface.

7. The lounge chair of claim 1, wherein the upper frame, the flexible support member, the plurality of linkage bars, the plurality of legs, the support frame and the fixing mechanism are configured to form a flat structure after being disassembled.

8. The lounge chair of claim 7, wherein when the lounge chair is in a flat packaged configuration, the plurality of linkage bars, the plurality of legs, the support frame, and the fixing mechanism are all positioned within a projected contour of the upper frame.

9. A seating device comprising:

an upper frame;

a base frame configured to be supported on a support surface and connected to the upper frame;

a support frame connected to the base frame;

a fixing mechanism detachably connected to the support frame; and a flexible support member comprising a plurality of elongated flexible members;

wherein each of the elongated flexible members passes through a gap defined in the fixing mechanism, with two upper ends of each of the elongated flexible members being fixedly connected to the upper frame; and connection of the fixing mechanism to the support frame causes the elongated flexible members to be gradually tightened.

10. The seating device of claim 9, wherein each of the elongated flexible members is integrally formed as a single piece extending between two upper ends thereof.

11. The seating device of claim 9, wherein the base frame comprises a plurality of linkage bars detachably connected to the upper frame and a plurality of legs, and each of the leg is connected to one of the linkage bars.

12. The seating device of claim 11, wherein the upper frame, the flexible support member, the plurality of linkage bars, the plurality of legs, the support frame and the fixing mechanism are configured to form a flat structure after being disassembled.

13. The seating device of claim 11, wherein the fixing mechanism comprises an inner ring, an outer ring and a fixing member fixed to the outer ring, the gap is defined between the inner ring and the outer ring, and the fixing member is detachably connected to the support frame.

14. The seating device of claim 11, wherein the inner ring comprises an outer surface facing the outer ring, and the outer surface is a concave surface.

15. A lounge chair comprising:

an upper frame;

a plurality of linkage bars detachably connected to the upper frame;

a plurality of legs, each connected to one of the linkage bars;

a support frame detachably connected to the plurality of linkage bars or the plurality of legs;

a fixing mechanism detachably connected to the support frame; and a flexible support member comprising a plurality of elongated flexible members;

wherein each of the elongated flexible members passes through a gap defined in the fixing mechanism, with two upper ends of each of the elongated flexible members being fixedly connected to the upper frame; and the plurality of elongated flexible members are clamped in the gap and arranged sequentially along an extending direction of the gap.

16. The lounge chair of claim 15, wherein the upper frame, the flexible support member, the plurality of linkage bars, the plurality of legs, the support frame and the fixing mechanism are configured to form a flat structure after being disassembled.

17. The lounge chair of claim 15, wherein each of the elongated flexible members is integrally formed as a single piece extending between two upper ends thereof.

18. The lounge chair of claim 15, wherein the fixing mechanism comprises an inner ring, an outer ring and a fixing member fixed to the outer ring, the gap is defined between the inner ring and the outer ring, and the fixing member is detachably connected to the support frame.

19. The lounge chair of claim 18, wherein the outer ring is configured to gradually tighten the plurality of elongated flexible members during a process of the fixing member being connected to the support frame.

20. The lounge chair of claim 18, wherein the inner ring comprises an outer surface facing the outer ring, and the outer surface is a concave surface.

* * * * *